US011851984B2

(12) United States Patent
Randle

(10) Patent No.: US 11,851,984 B2
(45) Date of Patent: Dec. 26, 2023

(54) EMERGENCY DISCONNECT ISOLATION VALVE

(71) Applicant: Bryce Elliott Randle, Highlands Ranch, CO (US)

(72) Inventor: Bryce Elliott Randle, Highlands Ranch, CO (US)

(73) Assignee: Spoked Solutions LLC, Houma, LA (US)

( * ) Notice: Subject to any disclaimer, the term of this patent is extended or adjusted under 35 U.S.C. 154(b) by 0 days.

(21) Appl. No.: 17/967,865

(22) Filed: Oct. 17, 2022

(65) Prior Publication Data

US 2023/0043285 A1 Feb. 9, 2023

Related U.S. Application Data

(63) Continuation of application No. 16/730,249, filed on Dec. 30, 2019, now Pat. No. 11,473,400, which is a continuation of application No. 15/767,462, filed as application No. PCT/US2016/056562 on Oct. 12, 2016, now Pat. No. 10,519,744.

(60) Provisional application No. 62/249,017, filed on Oct. 30, 2015, provisional application No. 62/240,111, filed on Oct. 12, 2015.

(51) Int. Cl.

| | |
|---|---|
| ***E21B 34/06*** | (2006.01) |
| ***E21B 21/10*** | (2006.01) |
| ***E21B 17/06*** | (2006.01) |
| ***E21B 17/00*** | (2006.01) |
| ***E21B 33/129*** | (2006.01) |
| ***E21B 34/12*** | (2006.01) |

(52) U.S. Cl.

CPC ..... *E21B 34/063* (2013.01); *E21B 17/006* (2013.01); *E21B 17/06* (2013.01); *E21B 21/10* (2013.01); *E21B 33/1294* (2013.01); *E21B 34/12* (2013.01)

(58) Field of Classification Search

CPC ..... E21B 34/063; E21B 34/12; E21B 17/006; E21B 17/06; E21B 21/10; E21B 33/1294

See application file for complete search history.

(56) References Cited

U.S. PATENT DOCUMENTS

| | | | |
|---|---|---|---|
| 4,160,478 | A | 7/1979 | Calhoun |
| 4,181,149 | A | 1/1980 | Cox |
| 4,183,404 | A | 1/1980 | James |
| 4,234,043 | A | 11/1980 | Roberts |
| 4,351,351 | A | 9/1982 | Flory |
| 4,583,593 | A | 4/1986 | Zunkel |

(Continued)

OTHER PUBLICATIONS

"QUANTUM Long-Stroke Safety Shear Sub," Schlumberger, @ 2014, 1 page.

(Continued)

*Primary Examiner* — Aaron L Lembo

(74) *Attorney, Agent, or Firm* — Heuton IP Law, LLC

(57) ABSTRACT

An isolation valve system, method, and apparatus are provided that can isolate a wellbore and prevent fluids from exiting the well and prevent seawater from entering the well. The system can be a two-part design in some embodiments where a shear sub is selectively interconnected to a body via shearing screws. A sufficient force on the shear sub destroys the shearing screws and the shear sub is removed from the body. This movement rotates an actuator on the body, which in turn rotates a valve in the body to provide the isolating function during routine operation of a wellbore or during an emergency.

4 Claims, 13 Drawing Sheets

(56) References Cited

U.S. PATENT DOCUMENTS

| | | | |
|---|---|---|---|
| 4,630,244 | A | 12/1986 | Larronde |
| 4,658,904 | A | 4/1987 | Doremus |
| 5,154,228 | A | 10/1992 | Gambertoglio |
| 5,758,682 | A | 6/1998 | Cain |
| 6,070,668 | A | 6/2000 | Parks |
| 6,152,229 | A | 11/2000 | Jennings |
| 6,789,627 | B2 | 9/2004 | Leismer |
| 7,234,527 | B2 | 6/2007 | Nivens |
| 7,240,734 | B2 | 7/2007 | Nivens |
| 7,469,754 | B2 | 12/2008 | Landry |
| 7,849,926 | B2 | 12/2010 | Inderberg |
| 8,151,888 | B2 | 4/2012 | Wright |
| 8,251,154 | B2 | 8/2012 | Duphorne |
| 8,662,183 | B1 | 3/2014 | Vickio |
| 8,770,278 | B2 | 7/2014 | Lauderdale |
| 9,016,388 | B2 | 4/2015 | Kellner |
| 10,323,478 | B2 | 6/2019 | Berscheidt |
| 10,519,744 | B2 | 12/2019 | Randle |
| 2008/0011479 | A1 | 1/2008 | Horton |
| 2010/0051847 | A1 | 3/2010 | Mailand |
| 2018/0080590 | A1 | 3/2018 | Mckay |

OTHER PUBLICATIONS

"Screen Out Surface Isolation Valve (SOSI)," Spoked Solutions, @ 2015, Technical Sheet 2 pages.

International Search Report and Written Opinion prepared by the United States Patent and Trademark Office dated Jan. 22, 2017, for International Application No. PCT/US2016/056562.

Notice of Allowance for U.S. Appl. No. 15/767,462, dated Aug. 26, 2019 11 pages.

Notice of Allowance for U.S. Appl. No. 16/730,249, dated Jun. 2, 2022 11 pages.

Official Action for U.S. Appl. No. 15/767,462, dated May 21, 2019 5 pages Restriction Requirement.

Official Action for U.S. Appl. No. 16/730,249, dated Jul. 9, 2021 5 pages Restriction Requirement.

EMERGENCY DISCONNECT ISOLATION VALVE

CROSS REFERENCE TO RELATED APPLICATION

This application is a continuation of U.S. patent application Ser. No. 16/730,249, now U.S. Pat. No. 11,473,400, filed Dec. 30, 2019, which is a continuation of U.S. patent application Ser. No. 15/767,462, now U.S. Pat. No. 10,519,744, filed on Apr. 11, 2018, which is a national stage application under 35 U.S.C. § 371 and claims the benefit of PCT Application No. PCT/US2016/056562 having an international filing date of Oct. 12, 2016, which designated the United States, which PCT application claimed priority to U.S. Provisional Application No. 62/240,111 filed on Oct. 12, 2015, and U.S. Provisional Application No. 62/249,017 filed on Oct. 30, 2015, the disclosures of each of which are incorporated herein in their entirety by reference.

FIELD OF THE INVENTION

The invention relates to mechanically operated isolation valves in a wellbore.

BACKGROUND OF THE INVENTION

Safety is paramount in wellbore operations for the workers on a drill rig and for the environment. A drill rig may be placed on a ground surface or on a platform in the ocean, and a drill establishes the wellbore in the earth. Then, casings are cemented in place to separate the wellbore and the surrounding formation. Tubulars extend through the casing to extract resources from the earth. However, in some instances an unstable formation, an erratic downwell pressure, a drifting drill rig in the ocean, or another emergency can cause a catastrophic destruction of the wellbore. This can result in the uncontrolled release of natural resources which can destroy a drill rig, injure workers, and harm the environment.

A blowout preventer is a device typically positioned at a wellhead that can isolate a wellbore during an emergency and prevent the uncontrolled release of natural resources. Blowout preventers come in several varieties. In one example, a ram blowout preventer uses two pistons, one positioned on each side of the wellbore, to drive respective rams into each other in the wellbore to sever and slicklines, cables, and tubulars to isolate the wellbore. In another example, a doughnut-like structure is positioned around the wellbore, and pistons drive the doughnut into the wellbore to isolate the wellbore. Additional systems such as a subsea test tree are an intermediate solution that temporarily isolates the wellbore without using the blowout preventer.

However, these various systems rely on hydraulic power or other systems of power that can be interrupted in extreme environments like a marine environment. Thus, the failure of a power system can lead to the failure of a blowout preventer and/or a subsea test tree and to the harm of workers and the environment.

SUMMARY OF THE INVENTION

It is therefore an aspect of embodiments of the present invention to provide a device, a system, and/or a method to isolate a wellbore using mechanical power and without the engagement of a blowout preventer. Mechanical power is less prone to failure, and mechanical force can easily be transmitted from the drill rig to a downhole location. A shear sub may be positioned over a body of an isolation system, and a force supplied to the shear sub causes the shear sub to detach from the body and rotate a valve from an open position to a closed position to isolate the wellbore without the need for the blowout preventer.

It is one aspect of embodiments of the present invention to provide an isolation system where a shear sub is selectively interconnected to a body via shear screws, and a catch of the shear sub drives an actuator to operate the valve. The actuator can be positioned on an outer surface of the body and selectively interconnected to a valve in the interior volume of the isolation system. Rotation of the actuator causes the valve to rotate between the open position and the closed position. The actuator is positioned in a slot of the shear sub, and the catch defines a portion of the slot. When the shear sub is removed, the catch contacts a protrusion of the actuator to rotate the actuator, and thus, rotate the valve from an open position to a closed position to isolate the wellbore.

It is another aspect of embodiments of the present invention to provide an isolation system that comprises a reentry sub that reattaches to the body after separation of the shear sub to reopen the valve and reopen access to the wellbore. The reentry sub also has a slot that engages the actuator, and the reentry sub has guide features that are positioned in a guide channel of the body to orient the reentry sub and the body to reopen the valve. The guide channel has four orientation zones. First, the reentry sub contacts the body, and then the reentry sub rotates until a guide feature progresses through the first orientation zone, at the end of which the reentry sub and the body are in a first angular orientation. Next, the reentry sub extends longitudinally along the body in the second orientation zone to cover more of the body. In a third orientation zone, the reentry sub rotates relative to the body, and a reentry catch on the reentry sub contacts the protrusion of the actuator to rotate the actuator and rotate the valve to the open position. In the fourth orientation zone, the reentry sub further progresses along the body, and a shear ring on an inner surface of the reentry sub sets into a channel on the outer surface of the body to selectively interconnect the reentry sub to the body.

It is another aspect of embodiments of the present invention to provide an isolation system that may be used in a drill string or work string. Therefore, the isolation system can isolate gases and fluids at a certain point rather than the entire wellbore. In this isolation system, a valve isolates a first enclosed volume and a second enclosed volume. Bleeding valves are operatively interconnected to both enclosed volumes. The primary valve and the bleeding valves can be manually or electronically operated from the outer surface of the isolation system to control the pressures of gases and fluids in the drill string or work string.

One particular embodiment of the present invention is a system for disconnection in a drilling operation, comprising a body having an interior volume and an outer surface, the body having a seal positioned in the interior volume and a valve positioned in the seal, the valve is rotatable between an open position and a closed position, the body having an actuator disposed on the outer surface of the body, and the actuator is interconnected the valve; a shear sub at least partially covering the outer surface of the body, the shear sub having a slot and the actuator of the body is positionable in the slot; and a shearing mechanism selectively interconnects the shear sub to the body and selectively disconnects the shear sub from the body when the shear sub is subjected to a predetermined shear force, wherein when the shear sub selectively disconnects from the body, the shear sub rotates the actuator as the actuator is removed from the slot of the shear sub to rotate the valve from the open position to the closed position.

In various embodiments, a protrusion of the actuator extends from an axis of rotation of the actuator; and a catch of the shear sub extends into the slot of the shear sub, wherein the catch drives the protrusion around the axis of rotation to rotate the actuator, which rotates the valve from the open position to the closed position when the shear sub is selectively disconnected from the body. In some embodiments, the shearing mechanism is a plurality of shear screws arrayed about a longitudinal axis of the body and the shear sub. In various embodiments, a tab is disposed on the outer surface of the body and positioned proximate to the actuator, wherein the tab is deflected when the shear sub is selectively interconnected to the body, and the tab is extended when the shear sub is selectively disconnected from the body to prevent rotation of the actuator and rotation of the valve from the closed position.

In certain embodiments, the shear sub rotates the actuator approximately 90 degrees about an axis of rotation to rotate the valve from the open position to the closed position when the shear sub is selectively disconnected from the body. In various embodiments, a second actuator is disposed on the outer surface of the body, and the second actuator is interconnected to the valve; and a second slot of the shear sub, and the second actuator of the body is positionable in the second slot, wherein when the shear sub is selectively disconnected from the body, the shear sub rotates the second actuator as the second actuator is removed from the second slot to rotate the valve from the open position to the closed position.

In various embodiments, a guide slot is on an outer surface of the body; a reentry sub having a guide feature that is positionable in the guide slot, and the reentry sub comprises a reentry slot; and after the shear sub disconnects from the body, the reentry sub is configured to selectively interconnect to the body, and the actuator is positionable in the reentry slot, and wherein the guide feature in the guide slot orients the reentry sub and the reentry slot to rotate the actuator and rotate the valve from the closed position to the open position. In various embodiments, the guide slot comprises four orientation zones (i) a first orientation zone allows the rotation of the reentry sub relative to the body to align the reentry sub and the body in a first angular orientation; (ii) a second orientation zone allows the reentry sub to progressively cover the body along a longitudinal length of the body; (iii) a third orientation zone allows further rotation of the reentry sub relative to the body to align the reentry sub and the body in a second angular orientation; and (iv) a fourth orientation zone allows the reentry sub to further progressively cover the body along the longitudinal length of the body. In some embodiments, a shear ring is positioned in a channel on an inner surface of the reentry sub; and a channel is disposed on the outer surface of the body, wherein the reentry sub is positioned over the body and the shear ring is positioned in the channel of the body to selectively interconnect the reentry sub and the body.

Another particular embodiment of the present invention is a method for operating an emergency disconnect isolation valve, comprising (i) providing a body having an interior volume, a valve positioned in the interior volume, and an actuator on an outer surface of the body, wherein the actuator is operably interconnected to the valve; (ii) positioning a shear sub over at least part of the outer surface of the body, and positioning the actuator in a slot of the shear sub; (iii) selectively interconnecting the shear sub to the body with a shear mechanism that is configured to shear apart when the shear sub is subjected to a predetermined shear force; (iv) applying the predetermined shear force to the shear sub so that the shear mechanism shears apart and the shear sub disconnects from the body along a longitudinal axis of the body; and (v) rotating, by a catch of the shear sub, the actuator as the shear sub disconnects from the body to rotate the valve of the body from an open position to a closed position.

In some embodiments, the method further comprises (vi) providing a tab on the outer surface of the body and positioning the tab proximate to the actuator; (vii) deflecting the tab by a portion of the shear sub when the shear sub is selectively interconnected to the body; and (viii) extending the tab when the shear sub is selectively disconnected from the body to prevent rotation of the actuator and rotation of the valve from the closed position.

In various embodiments, the method further comprises (ix) providing a protrusion of the actuator that extends from an axis of rotation of the actuator; and (x) contacting the protrusion of the actuator with the catch of the shear sub to rotate the actuator and rotate the valve. In certain embodiments, the method further comprises (xi) providing a guide slot on the outer surface of the body, and providing a guide feature on an inner surface of a reentry sub; (xii) positioning the guide feature in a first orientation zone of the guide slot and rotating the reentry sub to a first angular orientation with respect to the body; (xiii) extending the guide feature in a second orientation zone of the guide slot to cover a portion of the body with the reentry sub along a longitudinal length of the body; and (xiv) positioning the guide feature in a third orientation zone of the guide slot and rotating the reentry sub to a second angular orientation with respect to the body so that the catch of the reentry sub rotates the actuator and rotates the valve from the closed position to the open position.

In various embodiments, the method further comprises (xv) providing a channel on the inner surface of the reentry sub and a shear ring in the channel; (xvi) extending the guide feature in a fourth orientation zone of the guide slot to cover a further portion of the body with the reentry sub along the longitudinal length of the body to set the shear ring in a channel on the outer surface of the body to selectively interconnect the reentry sub and the body. In some embodiments, the method further comprises (xvii) re-deflecting the tab by a portion of a reentry sub when the reentry sub covers a portion of the body along a longitudinal length of the body. In certain embodiments, the method further comprises (xviii) providing a reentry sub, and positioning the reentry sub over the body; (xix) contacting a leading edge of the reentry sub with a receiving edge of the body; (xx) supplying a fluid through an interior volume of the reentry sub to register a pressure increase and confirm a seal between the reentry sub and the body.

One particular embodiment of the present invention is an isolation system for a borehole operation, comprising an isolation valve having an element positioned between a first end and a second end of the isolation valve, wherein the element is rotatable between an open position and a closed position; a first enclosed volume proximate to the first end of the isolation valve; a second enclosed volume proximate to the second end of the isolation valve, wherein the element segregates the first enclosed volume and the second enclosed volume when the element is in the closed position, and a shaft of the element extends to a side surface of the isolation valve; an actuator having an element recess configured to operatively interconnect to the shaft of the element, wherein the actuator is configured to rotate the element between the open position and the closed position; and a first alignment feature and a second alignment feature positioned on the side surface of the isolation valve, wherein the first alignment feature and the second feature combine to align the actuator and the isolation valve and to align the shaft and the element recess.

In some embodiments, a drive recess of the actuator is configured to receive the distal end of a rotatable tool, and a gearbox disposed between the drive recess and the element recess of the actuator. In various embodiments, the gearbox is configured to rotate the element recess with a greater torque than the drive recess. In certain embodiments, a first bleeding valve is positioned on the isolation valve and operatively interconnected to the first enclosed volume to control the pressure within the first enclosed volume; and a second bleeding valve is positioned on the isolation valve and operatively interconnected to the second enclosed volume to control the pressure within the second enclosed volume.

These and other advantages will be apparent from the disclosure of the invention(s) contained herein. The above-described embodiments, objectives, and configurations are neither complete nor exhaustive. The Background and Summary of the Invention is neither intended nor should it be construed as being representative of the full extent and scope of the invention. Moreover, references made herein to "the invention" or aspects thereof should be understood to mean certain embodiments of the invention and should not necessarily be construed as limiting all embodiments to a particular description. The invention is set forth in various levels of detail in the Background and Summary of the Invention as well as in the attached drawings and Detailed Description and no limitation as to the scope of the invention is intended by either the inclusion or non-inclusion of elements, components, etc. in this Background and Summary of the Invention. Additional aspects of the invention will become more readily apparent from the Detailed Description particularly when taken together with the drawings.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the disclosures.

Figure 1A:
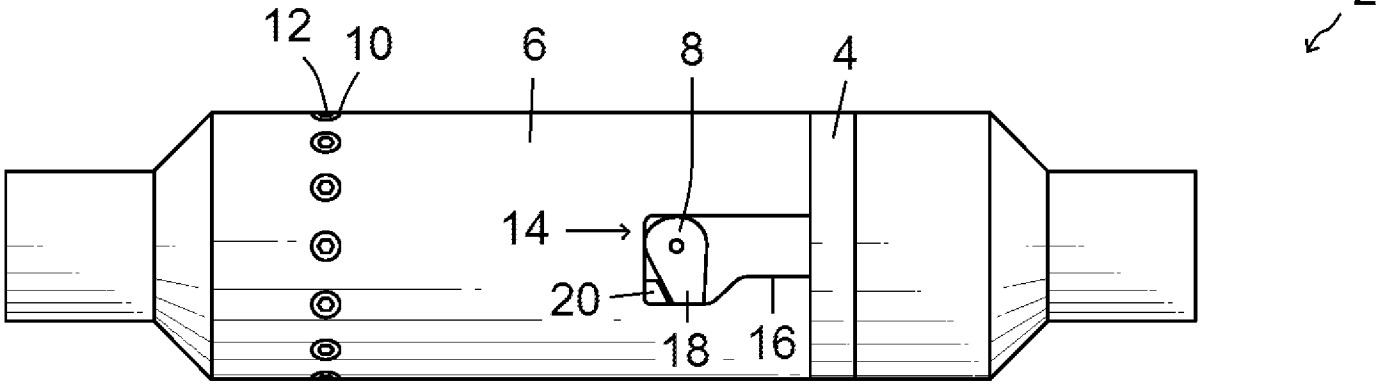
FIG. 1A shows a side elevation view of an isolation valve system in a first state in accordance with embodiments of the present invention.

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

The invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, and may be modified in numerous ways within the scope and spirit of the invention.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Various embodiments of the invention are described herein and as depicted in the drawings. Further, it is expressly understood that although the figures depict subs, bodies, valves, elements, and actuators, the invention is not limited to these embodiments.

Figure 1B:
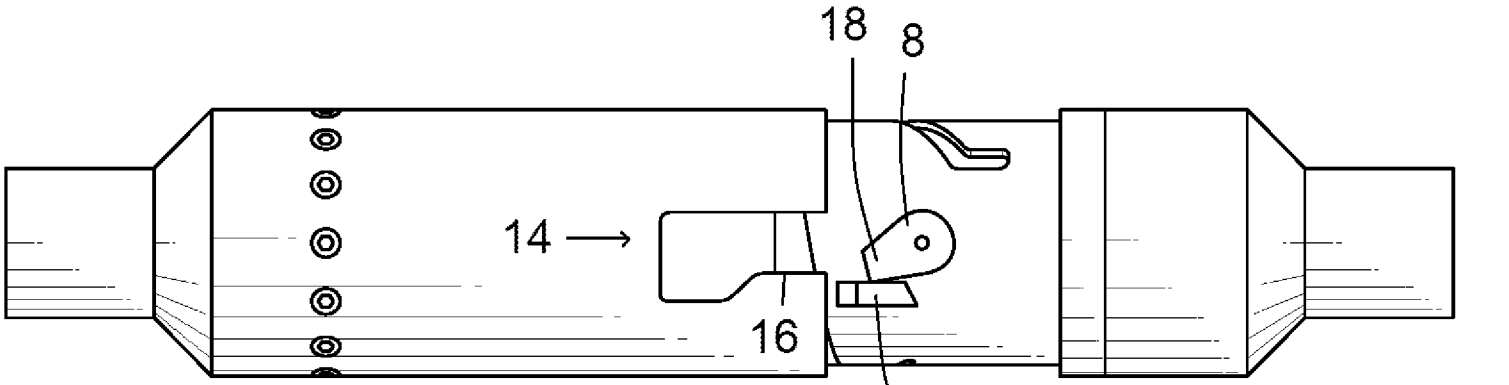
FIG. 1B shows a side elevation view of the isolation valve system of FIG. 1A in a second state in accordance with embodiments of the present invention.

Now referring to FIGS. 1A and 1B, side elevation views of an isolation system 2 are provided where the isolation system 2 in FIG. 1A has a valve in an open position and the isolation system 2 in FIG. 1B has the valve in a closed position. Referring to FIG. 1A, the isolation system 2 has a body 4 and a shear sub 6 selectively interconnected to each other. The body 4 has several components, including an actuator 8. The actuator 8 is operatively interconnected to the valve that is housed within an interior volume of the body 4. As the actuator 8 rotates on an outer surface of the body 4, the valve rotates between a closed position and an open position. In some embodiments, the actuator 8 is selectively interconnected to the valve. However, it will be appreciated that there are many ways to operably interconnect the actuator 8 to the valve, including a separate extension that interconnects the two components, a gear box such that the rate of rotation of the actuator 8 is distinct from the rate of rotation of the valve, etc.

The shear sub 6 has several apertures 10 that extend through the shear sub 6. In this embodiment, shear screws 12 extend through the apertures 10 and into a recess or channel in the body to selectively interconnect the shear sub 6 and the body 4. As shown in FIG. 1A, the apertures 10 and the shear screws 12 are arrayed around a longitudinal axis of the shear sub 6 and the body 4, but it will be appreciated that other configurations of apertures 10 and shear screws 12 can be utilized to selectively interconnect the shear sub 6 to the body 4. The shear screws 12 are designed to shear apart when subjected to a predetermined shear force. During operation of the isolation system 2, a predetermined shear force can be applied to the shear sub 6 so that the shear screws separate, and the shear sub 6 is removed from the body 4 along the longitudinal axis of the shear sub 6 and the body 4.

The shear sub 6 comprises a slot 14 at one end of the shear sub 6, and the actuator 8 of the body 4 is positioned in the slot 14. A catch 16 of the shear sub 6 extends into the slot 14. Therefore, when the shear sub 6 is removed from the body 4, the catch 16 contacts the actuator 8 and rotates the actuator 8. In turn, the actuator 8 rotates the valve from an open position to a closed position. As the valve closes it severs various slicklines, electric lines, casings, and tubulars and isolates the wellbore.

In further detail, the particular shapes of the actuator 8, the slot 14, and the catch 16 allow for operation of the isolation system 2. The actuator 8 has a first radial dimension and a second radial dimension, which is defined by a protrusion 18. The second radial dimension is larger than the first radial dimension. The slot 14 has a first width dimension and a second width dimension, which is defined by the catch 16. The first width dimension is larger than the second width dimension. As shown in FIG. 1A, the first width dimension is approximately equal to the first radial dimension plus the second radial dimension, and the second width dimension is approximately equal to two first radial dimensions. The shapes of these components allow the catch 16 to contact the protrusion 18 and drive the protrusion 18 about an axis of rotation of the actuator 8. However, it will be appreciated that there are many various shapes that can be used for the actuator 8, the slot 14, and the catch 16 to allow for operation of the isolation system in accordance with the present invention.

FIG. 1B shows the shear sub 6 nearly completely removed from the body 4, and the actuator 8 has turned 90 degrees, or a quarter turn. Also shown in FIG. 1B is a tab 20 in an extended position, which prevents the actuator 8 from rotating backwards and prevents the valve from rotating from the closed position to the open position. The tab 20 is in a deflected position in FIG. 1A when the shear sub 6 is covering at least a portion of the body 4. As the shear sub 6 is removed from the body 4 and after the actuator 8 has rotated, the tab springs back to an extended position that inhibits rotation of the actuator 8.

Figure 2B:
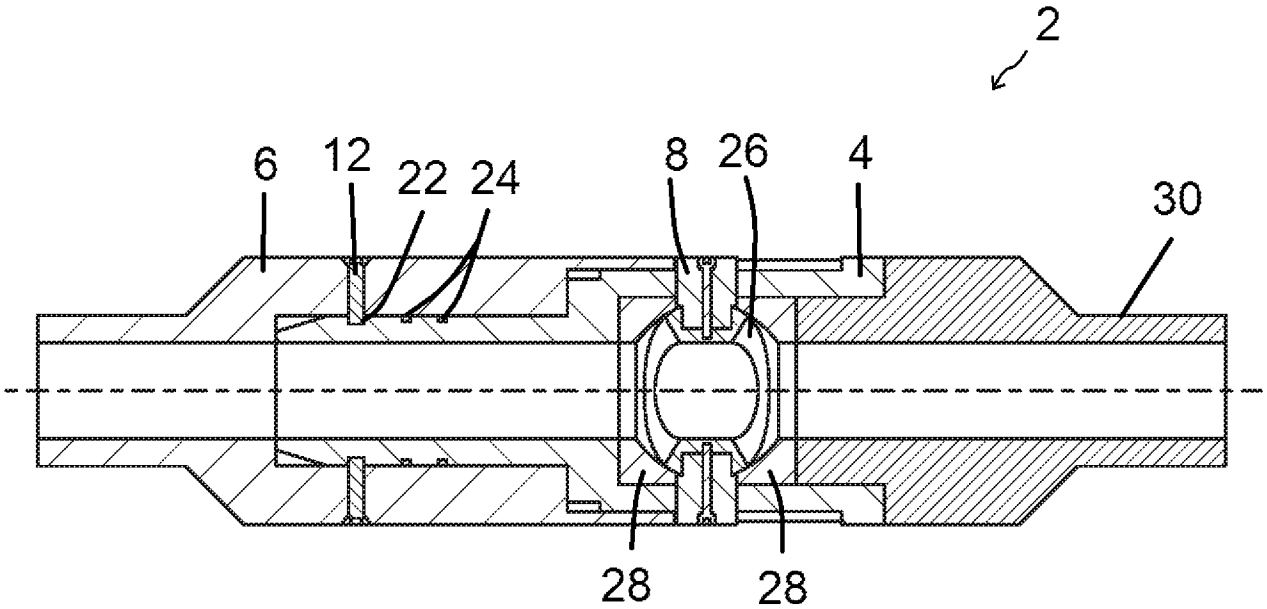
FIG. 2B is a cross sectional view of the isolation valve system taken along line A-A shown in FIG. 2A in accordance with embodiments of the present invention.
Figure 2A:
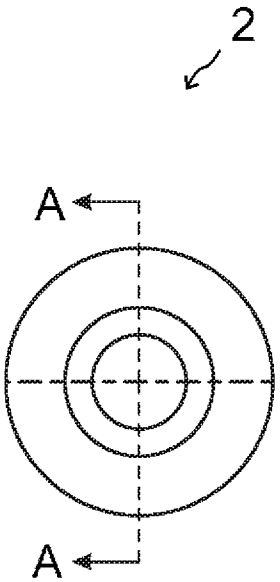
FIG. 2A is a front elevation view of the isolation valve system of FIGS. 1A and 1B in accordance with embodiments of the present invention.

FIG. 2A shows a front elevation view of the isolation system 2, and FIG. 2B shows a cross sectional view of the isolation system 2 taken along line A-A in FIG. 2A. Referring to FIG. 2B, the shear sub 6 is selectively interconnected to the body 4 via shear screws 12, which are set into a channel 22 in the body 4. Seal channels 24 are locations for o-rings or other sealing components to provide a fluid-tight seal between the shear sub 6 and the body 4.

Also shown in FIG. 2B is the valve 26 set between a pair of seals 28, and the actuator 8 is selectively interconnected to the valve 26. The valve 26 is in the open position in this embodiment since the shear sub 6 is selectively interconnected to the body 4. In a closed position, the valve 26 will rotate to isolate the wellbore. A lower portion 30 is interconnected to the body 4, and the lower portion 30 and the body 4 remain in the well after the shear sub 6 has separated.

Figure 3:
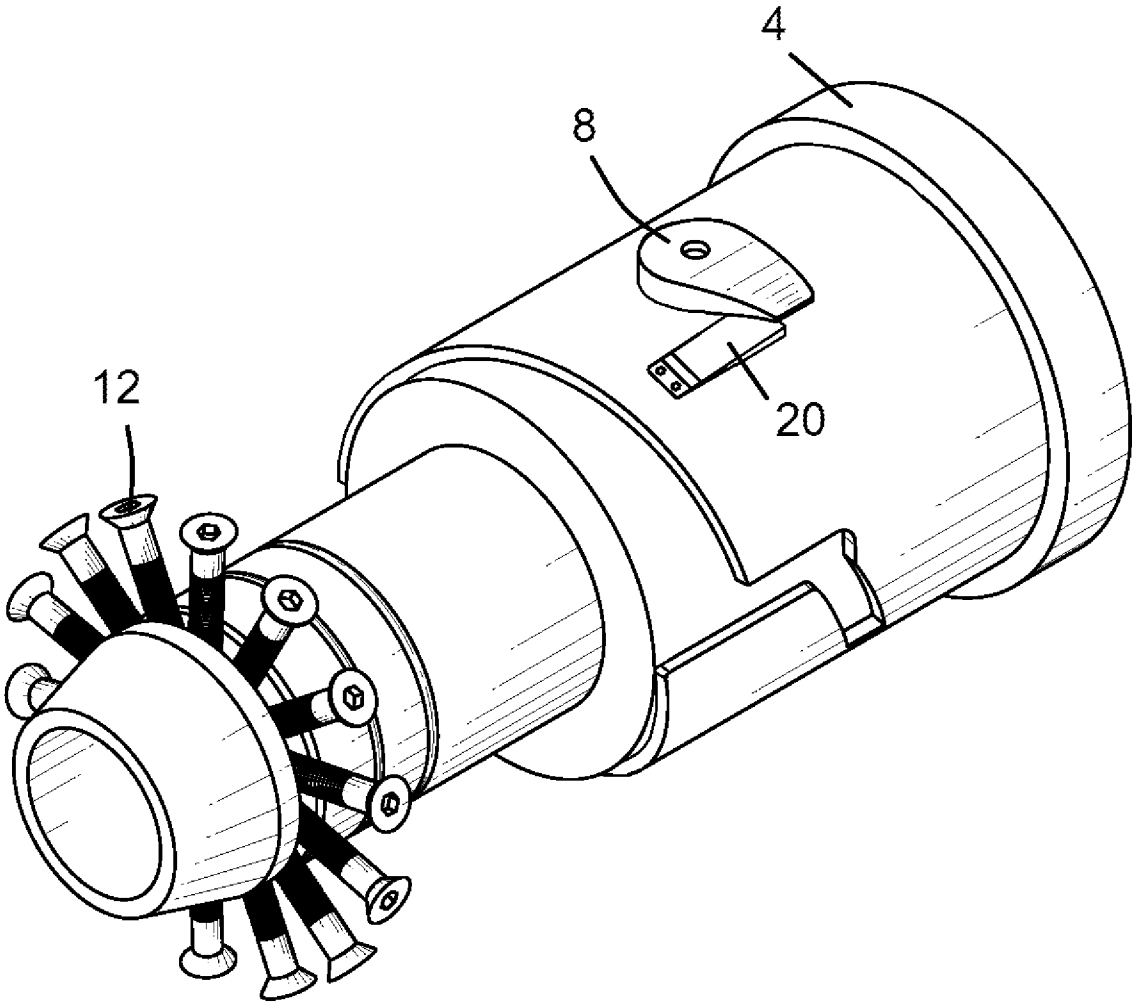
FIG. 3 is a perspective view of a body of the isolation valve system of FIGS. 1A and 1B and related components in accordance with embodiments of the present invention.

FIGS. 3-7 further illustrate some of the components of the isolation system 2. FIG. 3 shows a perspective view of the body 4 with various components, including the shear screws 12, the actuator 8, and the tab 20. FIGS. 4A and 4B show side elevation views of the body 4 and various components from FIG. 3. The embodiment depicted in FIGS. 3-4B has two sets of actuators 8, tabs 20, etc. positioned on opposing sides of the body 4. It will be appreciated that in some embodiments, the body 4 can have only one set of these components, or in some embodiments, more sets or subsets of these components.

Figure 4A:
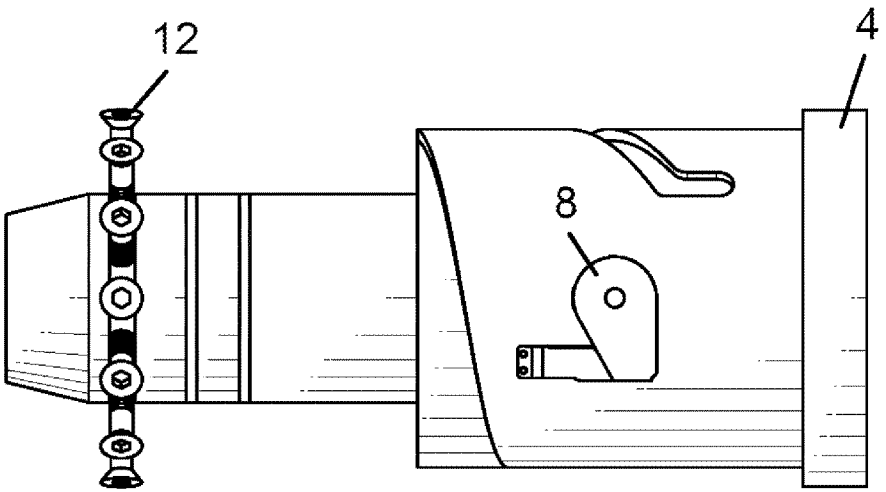
FIG. 4A is a side elevation view of the body of FIG. 3 and related components in accordance with embodiments of the present invention.
Figure 4B:
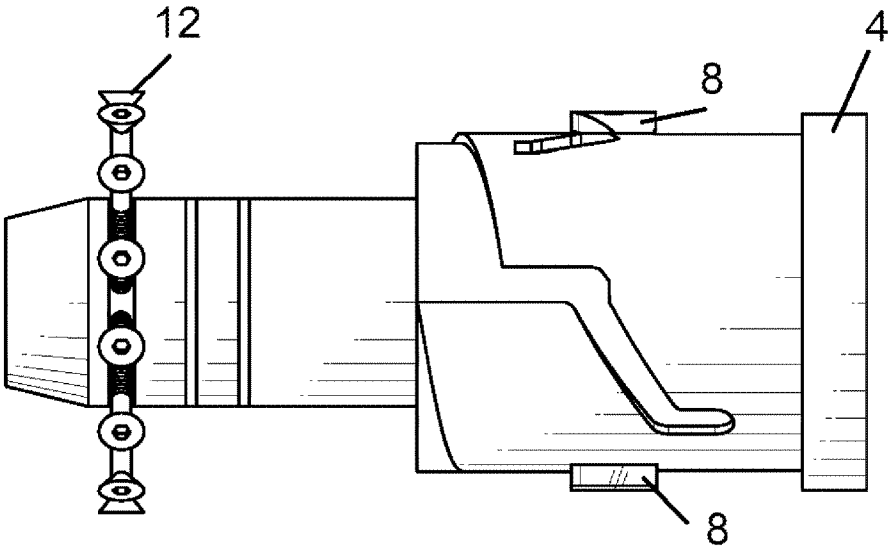
FIG. 4B is a top plan view of the body of FIG. 3 and related components in accordance with embodiments of the present invention.
Figure 5:
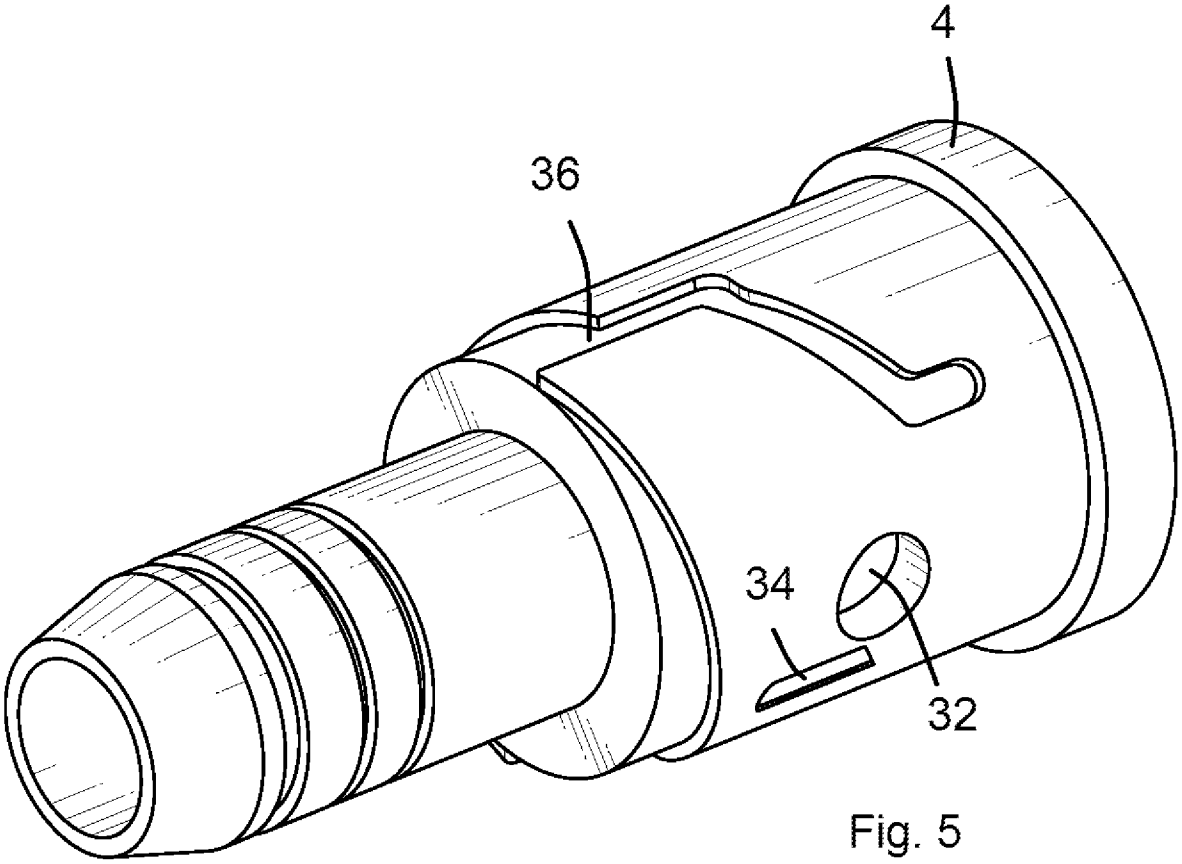
FIG. 5 is a perspective view of the body of the isolation valve system of FIGS. 1A and 1B without related components in accordance with embodiments of the present invention.

FIG. 5 is a perspective view of the body 4 in FIGS. 3-4B without the associated components. An actuator aperture 32 is shown on the side of the body 4, and the actuator aperture 32 is the location on the body 4 where the actuator 8 is seated and allows for access to the interior volume of the body 4. The tab recess 34 is also shown on the side of the body 4, and the tab recess 34 provides a space for the tab 20 shown in FIGS. 1A and 1B to deflect into. Lastly, a guide slot 36 is shown in FIG. 5, and this guide slot 36 is relevant to the reentry sub described in further detail below.

Figure 6A:
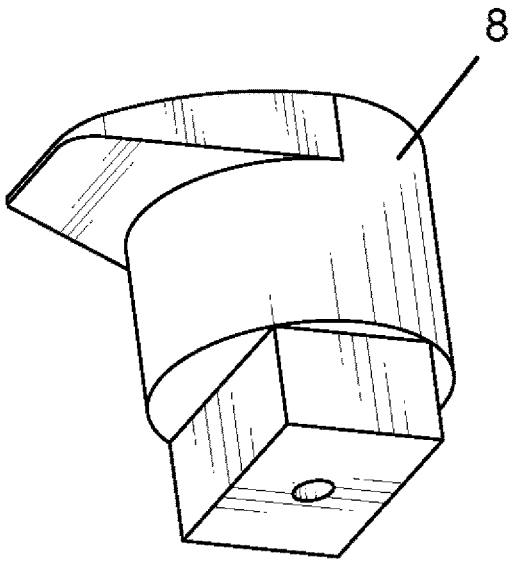
FIG. 6A is a perspective view of an actuator of the isolation valve system of FIGS. 1A and 1B in accordance with embodiments of the present invention.
Figure 6B:
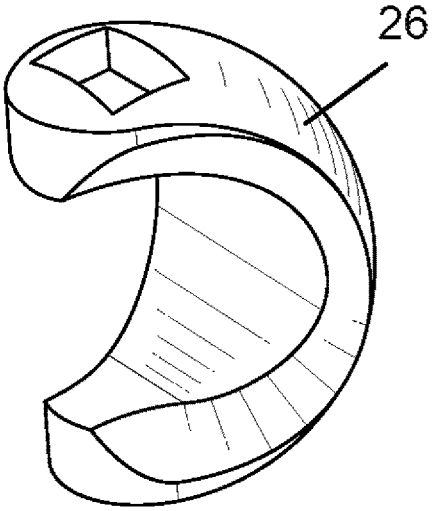
FIG. 6B is a perspective view of a valve of the isolation valve system of FIGS. 1A and 1B in accordance with embodiments of the present invention.
Figure 6C:
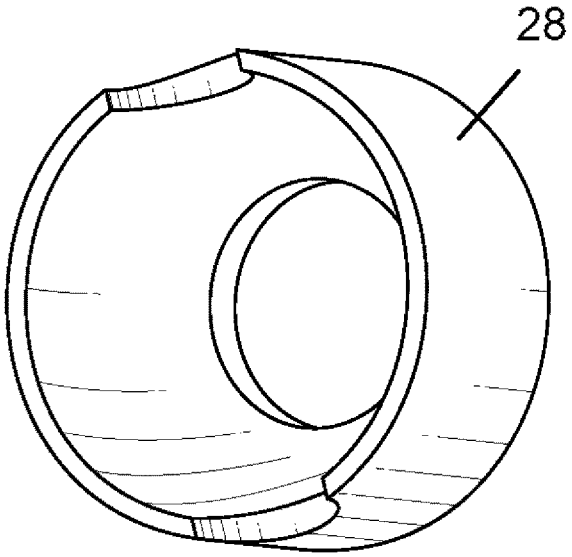
FIG. 6C is a perspective view of a seal of the isolation valve system of FIGS. 1A and 1B in accordance with embodiments of the present invention.
Figure 7:
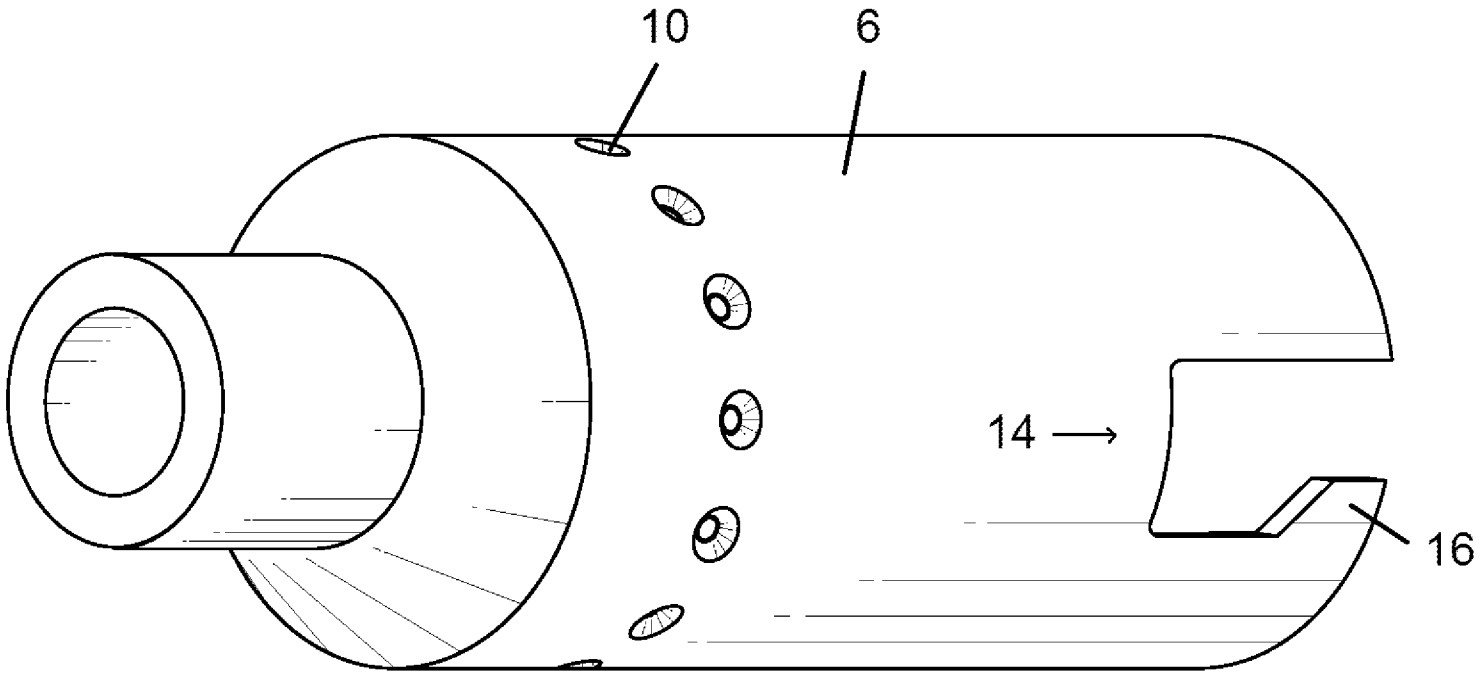
FIG. 7 is a perspective view of a shear sub of the isolation valve system of FIGS. 1A and 1B in accordance with embodiments of the present invention.

FIGS. 6A, 6B, and 6C show additional perspective views of the actuator 8, the valve 26, and the seal 28, respectively. FIG. 7 is an additional perspective view of the shear sub 6 showing the shear screw apertures 10, the slot 14, and the catch 16.

Figure 8:
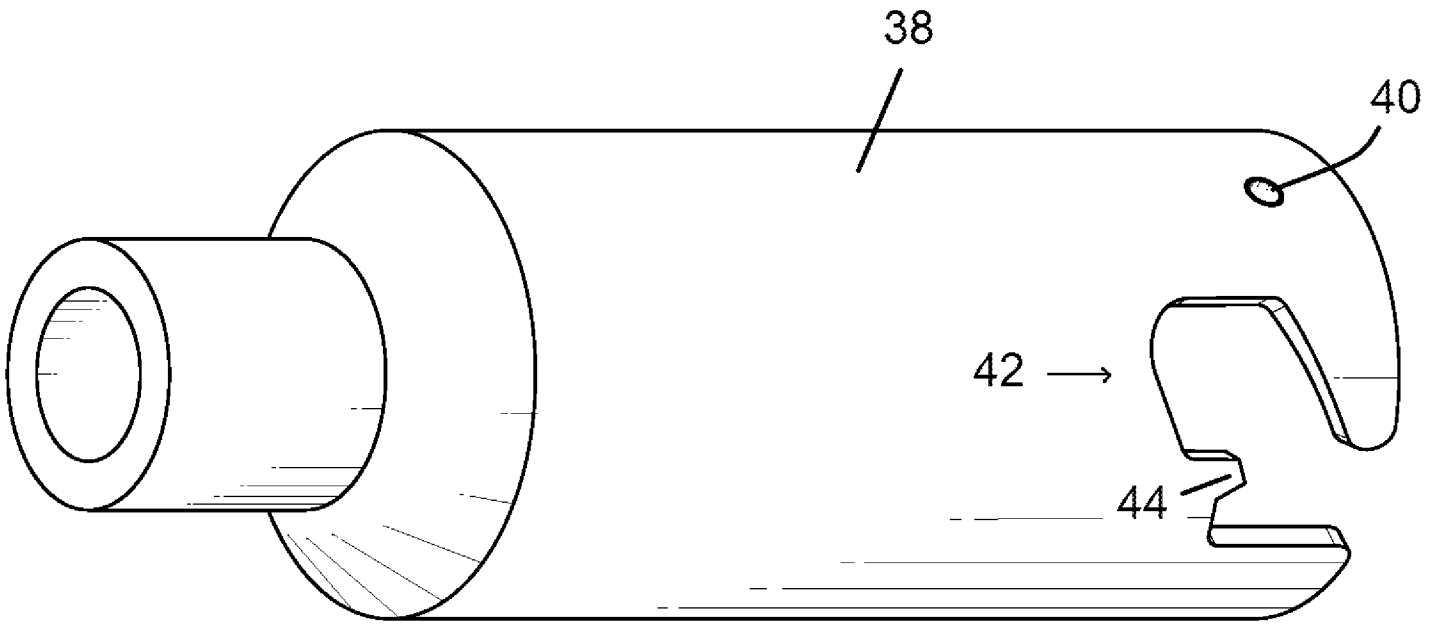
FIG. 8 is a perspective view of a reentry sub used in combination with the body in accordance with embodiments of the present invention.

FIGS. 8-11B illustrate a reentry sub 38 that selectively interconnects to the body 4 after the shear sub 6 is removed and the valve 26 is in the closed position. The reentry sub 38 reopens the valve 26 to provide access down the wellbore for any repairs or post-separate operations. As shown in FIG. 8, the reentry sub 38 has a slot 42 and a reentry catch 44 that are configured to interact with the actuator 8 to rotate the valve from a closed position to an open position. The reentry sub 38 also has a guide feature aperture 40 through which a guide feature orients the reentry sub 38 and the body 4 to operate the actuator.

Figure 9:
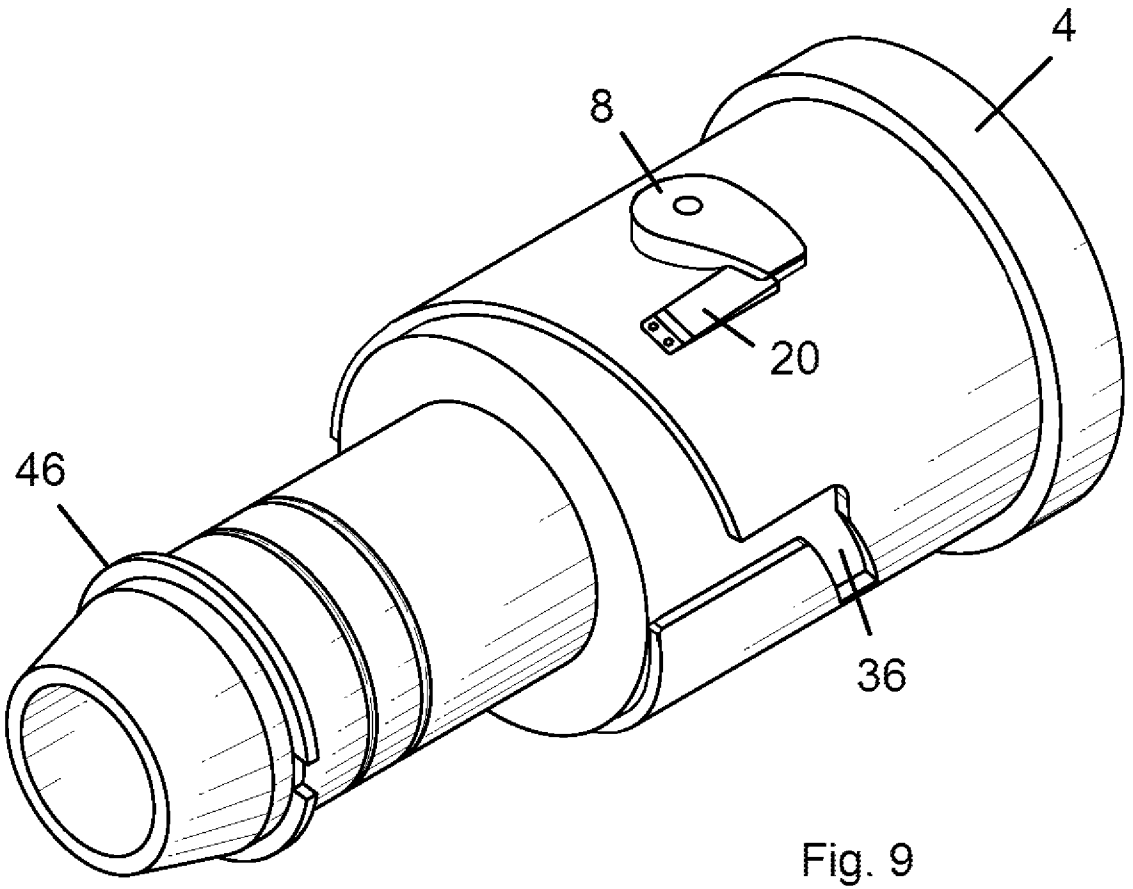
FIG. 9 is a perspective view of a body of an isolation valve system and related components in accordance with embodiments of the present invention.

FIG. 9 is a perspective view of the body 4 after the reentry sub 38 has rotated the actuator 8 over the tab 20, which causes the valve to rotate from the closed position to the open position. Also shown in FIG. 9 is the guide slot 36 that the guide feature of the reentry sub 38 is disposed in. In addition, a shear ring 46 is positioned in the channel 22 of the body 4. This shear ring 46 is originally positioned in the inner surface of the reentry sub 38 and selectively interconnects the reentry sub 38 to the body 4 when the reentry sub 38 is positioned over the body 4.

Figure 10A:
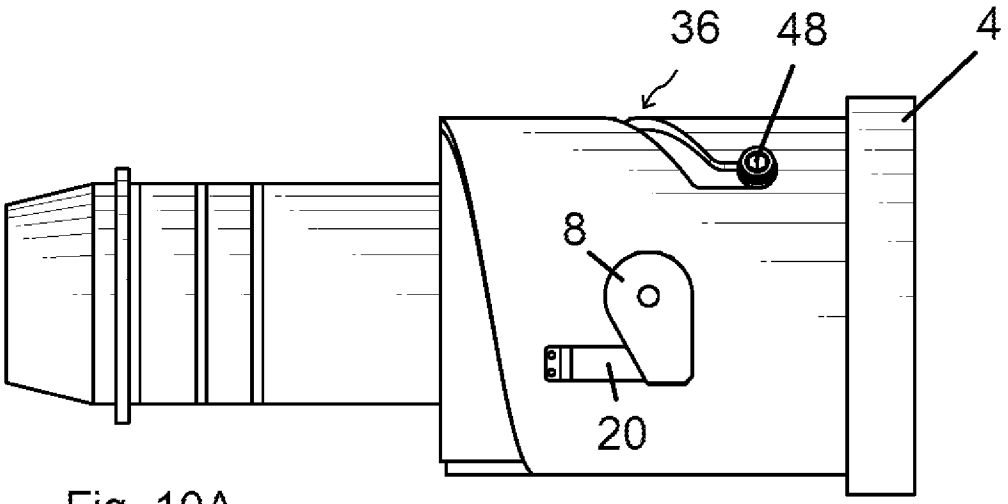
FIG. 10A is a side elevation view of the body of FIG. 9 and related components in accordance with embodiments of the present invention.
Figure 10B:
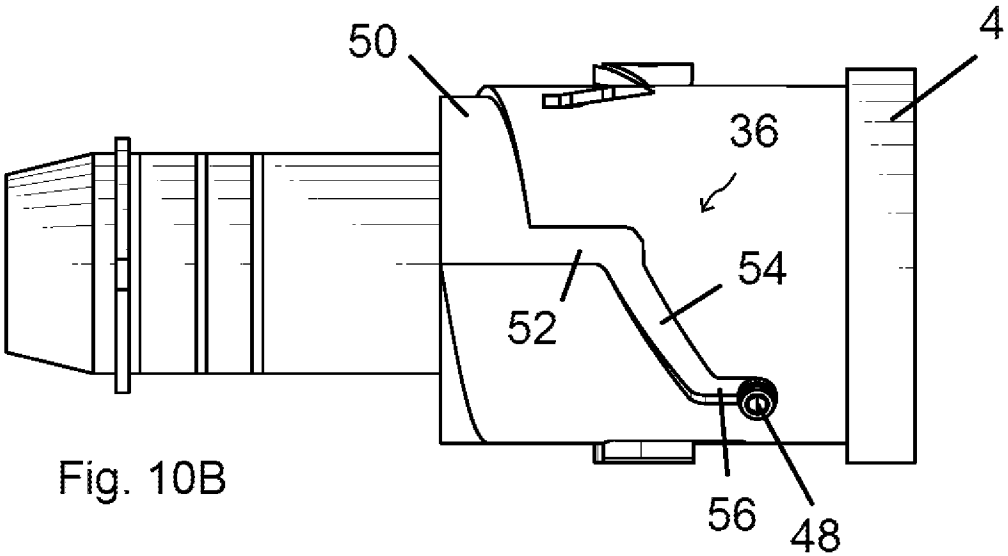
FIG. 10B is a top plan view of the body of FIG. 9 and related components in accordance with embodiments of the present invention.

FIGS. 10A and 10B are side elevation views of the body 4 of FIG. 9 that show the guide feature 48, and FIG. 10B shows the different zones of the guide slot 36. When the reentry sub 38 is first abutted against the body 4, an operator at the surface of the wellbore may pressurize a fluid in the interior of the reentry sub 38 to confirm a fluid-tight seal against the body 4 and to confirm that the valve is in the closed position. Next, in the first orientation zone 50 of the guide slot 36, the reentry sub 38 is rotated clockwise and the guide feature 48 orients the reentry sub 38 in a first angular orientation relative to the body 4. In this first angular orientation, the guide feature 48 is allowed to progress into the second orientation zone 52, and the reentry sub 38 progressively covers a portion of the body 4. While the guide feature 48 extends through the second orientation zone 52, the reentry sub 38 deflects the tab so that the actuator 8 can rotate about its axis of rotation.

Next, the guide feature 48 travels through the third orientation zone 54 until the reentry sub 38 and the body 4 are in a second angular orientation relative to each other. As the guide feature 48 travels through the third orientation zone 54, the reentry catch 44 contacts the protrusion portion of the actuator 8 to rotate the actuator, and thus, rotate the valve from a closed position to an open position. Lastly, the guide feature 48 is poised to extend down a fourth orientation zone 56. As the guide feature 48 extends down this fourth orientation zone 56, the shear ring 46 seats in the channel 22 of the body 4 to selectively interconnect the reentry sub 38 to the body 4. It will be appreciated that one or multiple guide slots 36 and guide features 48 may be used to orient and guide the reentry sub 38 relative to the body 4.

Figures 11A, 11B:
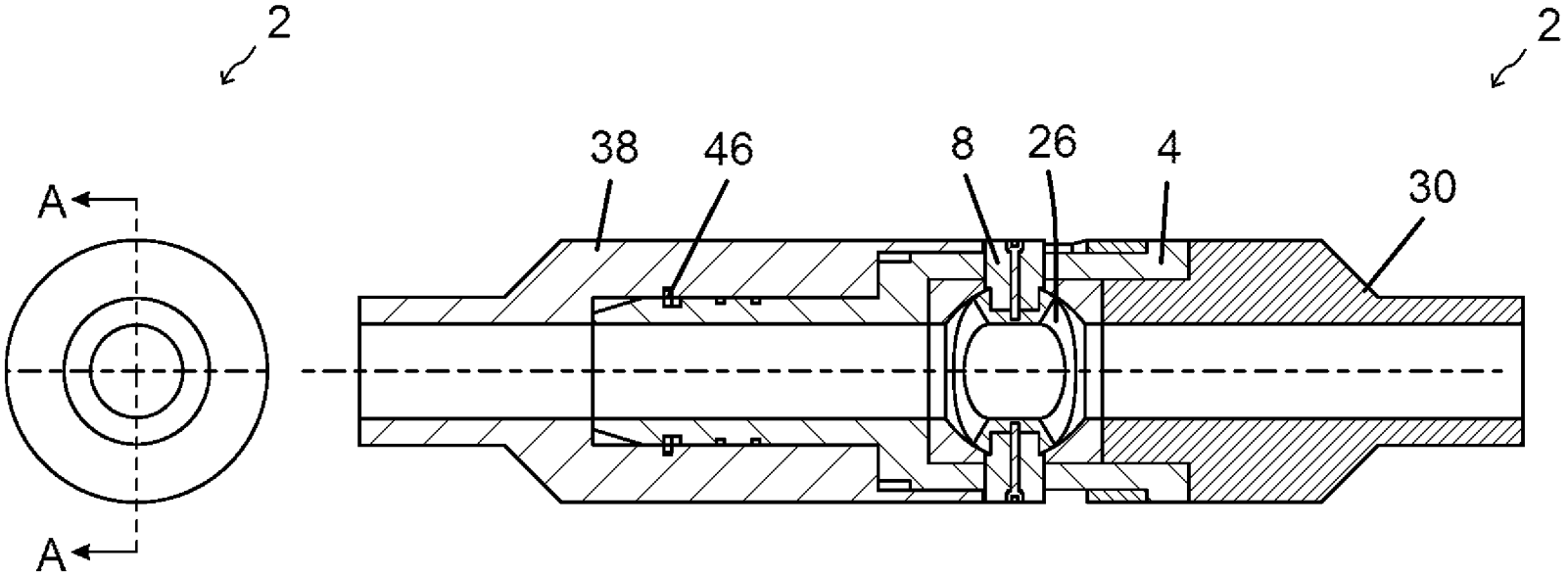
FIG. 11A is a front elevation view of an isolation valve system in accordance with embodiments of the present invention.
FIG. 11B is a cross sectional view of the isolation valve system taken along line A-A shown in FIG. 11A in accordance with embodiments of the present invention.

FIG. 11A is a front elevation view of the isolation system 2, and FIG. 11B is a cross sectional view of the isolation system 2 taken along line A-A of FIG. 11A. FIG. 11B shows the reentry sub 38 selectively interconnected to the body 4 via the shear ring 46, which is configured to break apart when subjected to a predetermined shear ring force. The valve 26 in FIG. 11B is in the open position, which provides access to the wellbore below the isolation system 2.

Figure 12:
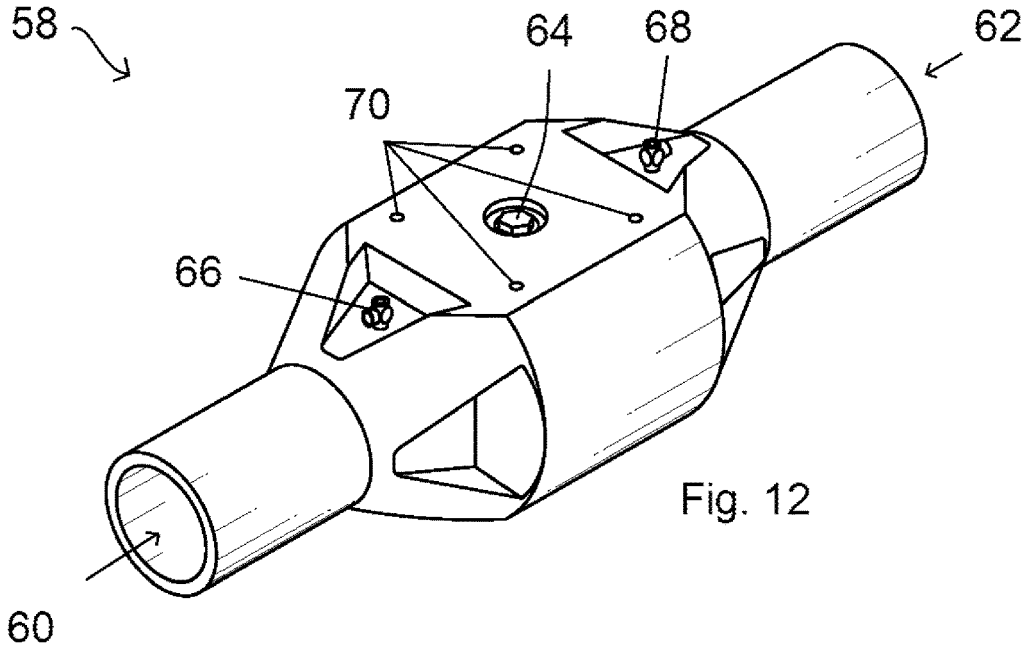
FIG. 12 is a perspective view of a second embodiment of an isolation valve system in accordance with embodiments of the present invention.

FIG. 12 is a perspective view of a screen out isolation valve system 58 according to another embodiment of the present invention. The isolation system 58 separates a first enclosed volume 60 at a first end of the isolation system 58 and a second enclosed volume 62 at a second end of the isolation system 58. The isolation system 58 can protect equipment from events in the wellbore such as a dramatic spike in pressure associated with a screen out. The ends of the isolation system 58 may be manufactured to selectively interconnect to other tubulars or casings within a workstring in a wellbore. For example, one or both of the ends may be manufactured for a 6⅝" Box Premium Connection. Fluid or gas may flow between the ends and through the isolation system 58, provided a valve in the isolation system 58 is in an open position.

The end of a shaft 64 extends to a side surface of the isolation system 58, and the shaft 64 provides access for operation of the valve between the open position and a closed position. When the valve is in the closed position a pressure differential can form between the first enclosed volume 60 and the second enclosed volume 62. To address the pressure differential, a first bleeding valve 66 is positioned on the side surface of the isolation system 58 and is operably interconnected to the first enclosed volume 60. Similarly, a second bleeding valve 68 is positioned on the side surface of the isolation system 58 and is operably interconnected to the second enclosed volume 62. An operator or a control unit may operate the bleeding valves 66, 68 to manipulate the pressure in the enclosed volumes 60, 62, including relieving pressure from one or both of the enclosed volumes 60, 62.

Also shown in FIG. 12 are various alignment features 70 that are configured to align the isolation system 58 with an external actuator to operate the valve between the open position and the closed position. The alignment features 70 are recesses or apertures in this embodiment that correspond to protrusions on the actuator. However, it will be appreciated that in other embodiments the alignment features 70 can be any feature that aligns the positions of two structures. The actuator (not shown) may comprise an element recess that operatively interconnects to the shaft 64 to operate the valve. In some embodiments, the actuator can include a gear box whereby an element recess is configured to receive a handtool. The handtool drives the element recess with a first torque and the gearbox translates the force from the handtool to the element recess and shaft 64 with a higher torque.

Figure 13A:
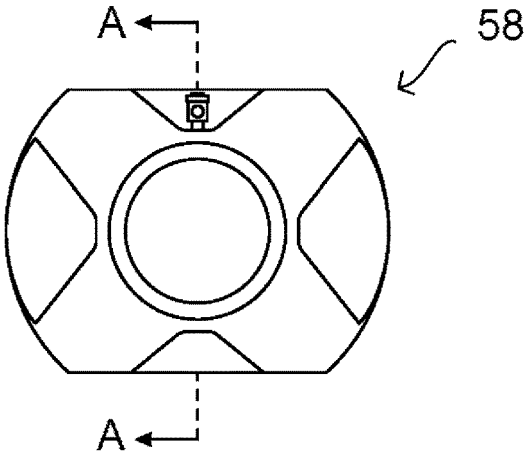
FIG. 13A is a front elevation view of the isolation valve system in FIG. 12 in accordance with embodiments of the present invention.
Figure 13B:
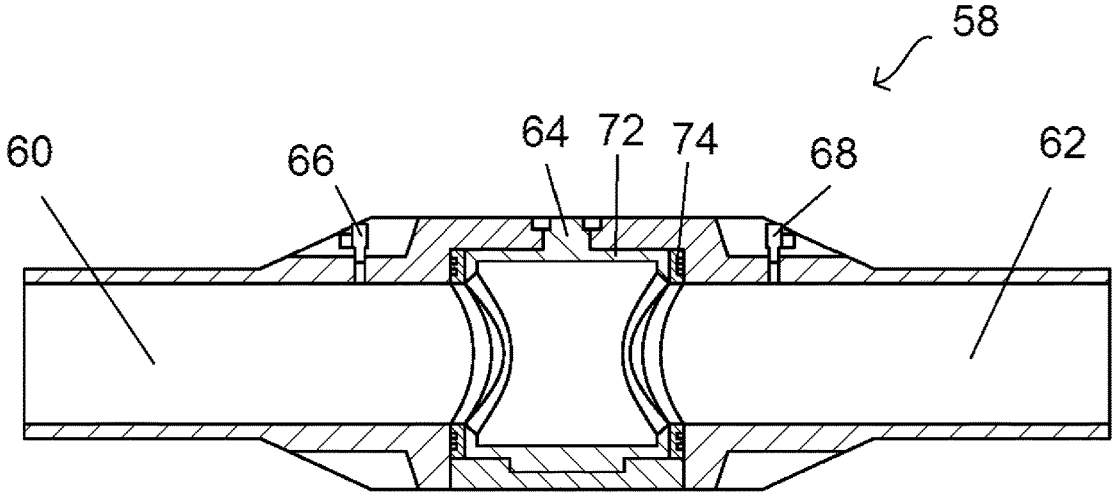
FIG. 13B is a cross sectional view of the isolation valve system taken along line A-A shown in FIG. 13A in accordance with embodiments of the present invention.

FIG. 13A shows a front elevation view of the isolation system 58, and FIG. 13B shows a cross sectional view of the isolation system 58 taken along line A-A in FIG. 13A. The cross sectional view of the isolation system 58 shows the first enclosed volume 60, the first bleeding valve 66, the second enclosed volume 62, and the second bleeding valve 68. A valve 72 is provided between the two enclosed volumes 60, 62, and the valve 72 is positioned in a seal 74. The valve 72 may rotate while maintaining an airtight or fluid-tight connection with the body of the isolation system 58. In some embodiments, the seal 74 is a two O-ring configuration that forms a double seal.

As shown in FIG. 13B, the shaft 64 extends from one side of the valve 72 to the side surface of the isolation system 58. A nut is placed over the opposite side of the valve 72 to allow rotation of the valve 72 about an axis. It will be appreciated that in other embodiments a second shaft extends from the valve 72 to a second side surface of the isolation system 58.

Figure 14A:
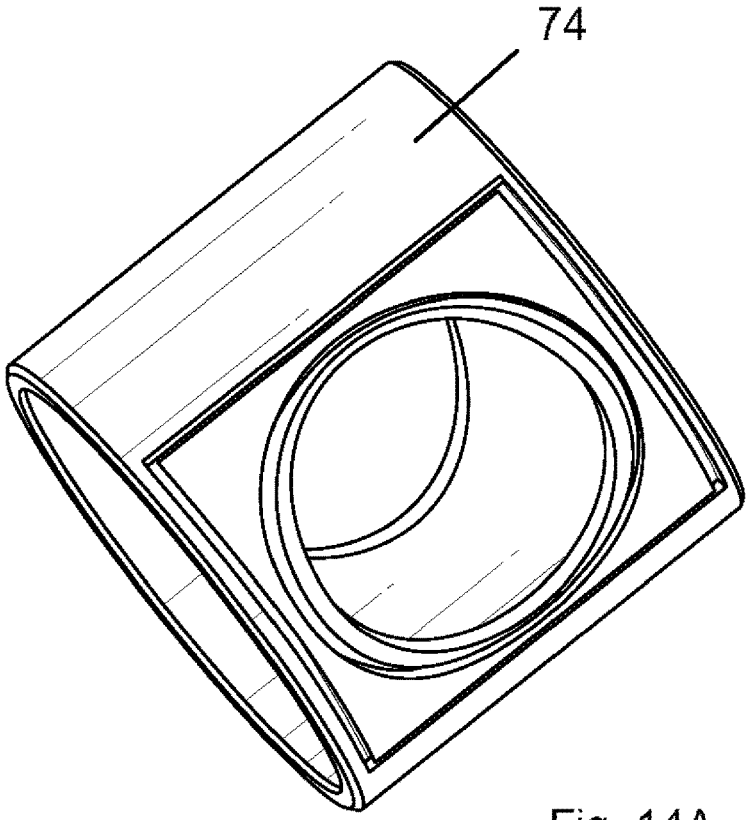
FIG. 14A is a perspective view of a seal of the isolation system in FIG. 12 in accordance with embodiments of the present invention.
Figure 14B:
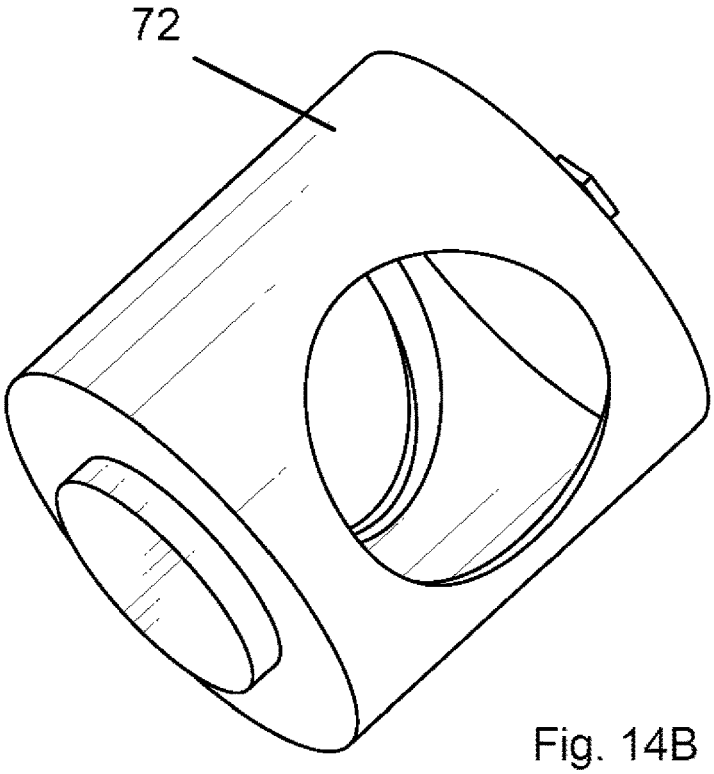
FIG. 14B is a perspective view of a valve element of the isolation system in FIG. 12 in accordance with embodiments of the present invention.

FIGS. 14A and 14B are perspective views of some components of the isolation system 58. FIG. 14A is a perspective view of a seal 74, and FIG. 14B is a perspective view of a valve 72.

The invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed.

The phrases "at least one", "one or more", and "and/or", as used herein, are open-ended expressions that are both conjunctive and disjunctive in operation. For example, each of the expressions "at least one of A, B, and C", "at least one of A, B, or C", "one or more of A, B, and C", "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification, drawings, and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having," and variations thereof, is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts, and the equivalents thereof, shall include all those described in the summary of the invention, brief description of the drawings, detailed description, abstract, and claims themselves.

The foregoing description of the invention has been presented for illustration and description purposes. However, the description is not intended to limit the invention to only the forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Consequently, variations and modifications commensurate with the above teachings and skill and knowledge of the relevant art are within the scope of the invention. The embodiments described herein above are further intended to explain best modes of practicing the invention and to enable others skilled in the art to utilize the invention in such a manner, or include other embodiments with various modifications as required by the particular application(s) or use(s) of the invention. Thus, it is intended that the claims be construed to include alternative embodiments to the extent permitted by the prior art.

What is claimed is:

1. An isolation system for a borehole operation, comprising:

an isolation valve having an element positioned between a first end and a second end of the isolation valve, wherein the element is rotatable between an open position and a closed position;

a first enclosed volume proximate to the first end of the isolation valve;

a second enclosed volume proximate to the second end of the isolation valve, wherein the element segregates the first enclosed volume and the second enclosed volume when the element is in the closed position, and a shaft of the element extends to a side surface of the isolation valve;

an actuator having an element recess configured to operatively interconnect to the shaft of the element, wherein the actuator is configured to rotate the element between the open position and the closed position; and a first alignment feature and a second alignment feature positioned on the side surface of the isolation valve, wherein the first alignment feature and the second feature combine to align the actuator and the isolation valve and to align the shaft and the element recess.

2. The system of claim 1, further comprising:

a drive recess of the actuator that is configured to receive the distal end of a rotatable tool, and a gearbox disposed between the drive recess and the element recess of the actuator.

3. The system of claim 2, wherein the gearbox is configured to rotate the element recess with a greater torque than the drive recess.

4. The system of claim 1, further comprising:

a first bleeding valve positioned on the isolation valve and operatively interconnected to the first enclosed volume to control the pressure within the first enclosed volume; and a second bleeding valve positioned on the isolation valve and operatively interconnected to the second enclosed volume to control the pressure within the second enclosed volume.

* * * * *